US006155482A

United States Patent [19]

Perry

[11] Patent Number: 6,155,482

[45] Date of Patent: Dec. 5, 2000

[54] MAIL DELIVERY SIGNAL KIT AND METHOD OF USE

[76] Inventor: William W. Perry, 6713 Stonycreek Dr., Oklahoma City, Okla. 73132

[21] Appl. No.: 09/339,696

[22] Filed: Jun. 24, 1999

[51] Int. Cl.[7] ..... B65D 91/00

[52] U.S. Cl. ..... 232/35

[58] Field of Search ..... 232/35, 34, 17, 232/45; 116/173–175; D99/29

[56] References Cited

U.S. PATENT DOCUMENTS

| | | | |
|---|---|---|---|
| 3,426,966 | 2/1969 | Lay . | |
| 3,675,845 | 7/1972 | Scheerer . | |
| 3,904,108 | 9/1975 | File . | |
| 4,063,681 | 12/1977 | Tong . | |
| 4,344,559 | 8/1982 | Widham . | |
| 4,382,541 | 5/1983 | Miller | 232/35 |
| 4,821,953 | 4/1989 | Poloha . | |
| 4,895,299 | 1/1990 | Okunami . | |
| 4,953,783 | 9/1990 | Chambers . | |
| 5,284,295 | 2/1994 | Steinfeldt . | |
| 5,366,148 | 11/1994 | Schreckengost . | |
| 5,489,064 | 2/1996 | Shively . | |
| 5,660,327 | 8/1997 | Brinkley, Jr. . | |

*Primary Examiner*—Terry Lee Melius
*Assistant Examiner*—William L. Miller
*Attorney, Agent, or Firm*—Dunlap, Codding & Rogers, P.C.

[57] ABSTRACT

A mail delivery signal kit which includes a magnet which can be mounted on a side or face of a mailbox door, a tethering device which is anchored to a portion of the mailbox, a stopper constructed of a metallic material which will connect to the magnet and which can be attached to one end of the tether, and a visual indicator device which can be retained on the tethering device, and which is adapted to be stopped by the stopper attached to the tethering device. A delivered mail indicating system is formed when the mail delivery signal kit is installed on a rural-type streetside mailbox. The delivered mail indicating system is activated when the stopper is magnetically connected to the magnet on the mailbox door. Opening of the mailbox door pulls the magnet away from the stopper until the stopper disconnects from the magnet, causing the stopper to fall below the mailbox wherein the visual indicator device drops down the tether and is arrested at the end of the tether by the stopper.

18 Claims, 1 Drawing Sheet

MAIL DELIVERY SIGNAL KIT AND METHOD OF USE

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to signaling devices designed to provide a visual indicator that mail has been delivered to a mailbox and more particularly, but not by way of limitation, to a kit for a mail delivery signaling device.

2. Brief Description of Prior Art

Since many mailboxes stand next to a street, highway, or road and are some distance from the residence or business, the owners of such mailboxes would greatly benefit from a visual signal which would confirm that mail has been delivered. The timing of mail delivery can be inconsistent, with delivery times varying from day to day for various reasons, including weather conditions. Such a signal would prevent unnecessary trips to the mailbox.

A number of such devices which display a visible component when the mailbox door is opened for mail delivery are known. U.S. Pat. No. 5,660,327 issued to Brinkley for a mailbox delivered mail signal involves a receptacle, fixed to the side of the mailbox, which holds a delivery indicator which is connected to the mailbox door by a filament or similar line; when the door is opened the delivery indicator is pulled free of the receptacle and the delivery indicator hangs in a visible position below the mailbox.

U.S. Pat. No. 5,489,064 issued to Shively for a mail box delivery indicator flag includes a flag pivotally mountable to a mailbox by a spring loading assembly and a retaining assembly for securing the flag into a flat position relative to the mailbox; the retaining assembly is released by mail delivery personnel to permit the spring loaded hinge to bias the flag into an upright position.

U.S. Pat. No. 5,366,148 issued to Schreckengost for a mailbox and signal includes a spring loaded signal rod attached to the mailbox by properly aligned cotter pins, one of which is located on the door of the mailbox; opening of the door releases the rod from the cotter pin, and the spring causes the rod to swing into an erect position.

U.S. Pat. No. 5,284,295 issued to Steinfeldt for a mailbox delivery signal device comprises a signal ball tethered to a planar support bracket mounted to the door of the mailbox; the ball rests upon the support bracket until the door is opened, causing the ball to fall and be suspended below the mailbox.

U.S. Pat. No. 4,895,299 issued to Okunami for a mail box with signaling device includes a signaling means comprising an indicia bearing portion, a metal portion, and a generally L-shaped member, one leg of which overlies at least a portion of the closed mailbox door, and a retention means comprising a magnet for attracting the metal portion of the signaling means which is mounted on the mailbox remote from the closure; when the door of the mailbox is opened, the retention means release the indicia bearing portion of the signaling means, which pivots away from the open mailbox door.

U.S. Pat. No. 4,821,953 issued to Poloha for a mailbox gravity signaling apparatus includes a suspension unit, comprising a mounting plate attached to the mailbox and a support arm to which a signal unit can be releasably secured, and a signal unit comprising a signal member suspended from a flexible chain connected to the suspension unit by one end, the signal member provided with a ring member that can be received by the support arm; when the mailbox door is opened, the signal member becomes disengaged from the suspension unit and falls into an activated position.

All of the previous devices have, in some manner, fulfilled the notification goal, but have generally accomplished it with expensive electronic or overly complex mechanisms, which include such things as springs, pivot arms, or electronic transmitters. Additionally, most of the previous devices are either difficult to install on an existing mailbox or must be manufactured as a part of a new mailbox. If these devices are built in to the mailbox during the original manufacturing stage, it is certain that the retail price of the mailbox would escalate.

While the prior art signaling devices fulfill their respective particular objectives and requirements, a new and improved signaling device composed of only a few, inexpensive, and easy to install parts would be desirable. In addition, it would be desirable to have a signaling device which can be easily removed when the mailbox owner chooses to have no visible signal on the mailbox indicating that mail has been delivered, such as when the owner is away from home or when a business is closed for an extended period of time. It is an object of the present invention to provide such a signaling device.

SUMMARY OF THE INVENTION

The present invention relates to signaling devices designed to provide a visual indicator that mail has been delivered to a mailbox. The present invention is removable, composed of only a few inexpensive parts, may be easily installed by unskilled persons and may be mounted on an existing mailbox before or after erection with few or only modifications thereto. Therefore, the present invention avoids the disadvantages and defects in the prior art. In one aspect, the present invention relates to a signaling kit designed to be added to an existing rural-type streetside metal or nonmetal mail delivery box which has a hinged door. In another aspect, the present invention relates to the system by which the delivery of mail is indicated by a visible signal after the mailbox door has been opened.

The mail delivery signal kit of the present invention consists of a magnet which can be mounted on a side or face of the mailbox door, a tethering device which is anchored to a portion of the mailbox, a stopper preferably constructed of a metallic material which will connect to the magnet and which can be attached to one end of the tether, and a visual indicator device which can be retained on the tethering device, and which is adapted to be stopped by the stopper attached to the tethering device.

A delivered mail indicating system is formed when the various components of the mail delivery signal kit contemplated herein are attached to the mailbox. The delivered mail indicating system is activated when the stopper is magnetically connected to the magnet on the mailbox. When the mailbox door is opened, the magnetic connection between the magnet and the stopper is broken, and gravity causes the stopper to fall, pulling down the tethering device. The visual indicator device slides down the tethering device and stops when it reaches the stopper; this is the signaling position of the delivered mail indicating system.

The visual indicator device is preferably brightly colored, fluorescent, metallic, sparkled, or the like, so that the visual indicator device is highly visible when dangling at the stopped position on the tethering device.

As will be evident herein, an object of the present invention is to provide a mail delivery signal kit which is connected to a mailbox.

Another object of the present invention, while achieving the before-stated object, is to provide a delivered mail indicating system which is combined with a mailbox having a hinged door through which articles are inserted and removed. The delivered mail indicating system signals when the mailbox door has been opened and mail has been delivered.

Another object of the present invention, while achieving the before-stated objects, is to provide a method for signaling delivery of mail to a mailbox when the door of the mailbox is opened.

Other objects, features, and advantages of the present invention will become apparent from the following detailed description when read in conjunction with the accompanying drawings and appended claims.

BRIEF DESCRIPTION OF THE DRAWINGS

FIG. 1 illustrates the delivered mail indicating system in an activated position in accordance with the present invention.

DESCRIPTION OF THE PREFERRED EMBODIMENTS

The signaling kit of the present invention comprises a magnet, a tethering device, a stopper, a visual indicator, and securing elements for connecting a first end of the tether to a mailbox or mailbox support and for securing the stopper to a second end of the tethering device. The magnet has a first surface and a second surface and is attachable to a surface by a securing element. The tethering device is a chain, string, cord, rope, wire, or plastic coated wire, and can be adjusted to have a length which is approximately the same or less than the length of a standard rural mailbox. The stopper has a first and a second surface and is constructed of a material which is able to be attracted by the magnet and is adapted to be connected to an end of the tether. The visual indicator is adapted to be slidably disposed upon or attached to the tether. At least a portion of the visual indicator device is brightly colored, iridescent, fluorescent, mirrored, metallic, sparkled, or combinations thereof.

The mailbox assembly of the present invention comprises a mailbox with a hinged door, a magnet attached to a surface of the hinged door, a tethering device connected at a first end thereof to the mailbox or to a mailbox support, a stopper constructed of a material able to be attracted by the magnet and connected to a second end of the tethering device, and a visual indicator device slidably disposed upon or attached to the tether. The tethering device is a chain, string, cord, rope, wire, or plastic coated wire, and can be adjusted to have a length which is approximately the same or less than the length of a standard rural mailbox. At least a portion of the visual indicator device is brightly colored, iridescent, fluorescent, mirrored, metallic, sparkled, or combinations thereof. Securing elements for connecting a first end of the tethering device to the mailbox or mailbox support and for connecting a second end of the tethering device to the stopper can also be provided, and the tethering device can be welded, screwed, clipped, or otherwise secured to the mailbox.

The method of activating a mail delivery signal comprises providing a mailbox assembly, which is described above, and magnetically connecting the stopper to the magnet attached to the door of the mailbox when the door is in a closed position. When the door of the mailbox is opened, the magnet is pulled away from the stopper until the stopper disconnects from the magnet, causing the stopper to fall below the mailbox wherein the visual indicator device drops down the tethering device and is arrested by the stopper, indicating mail delivery.

Figure 1:
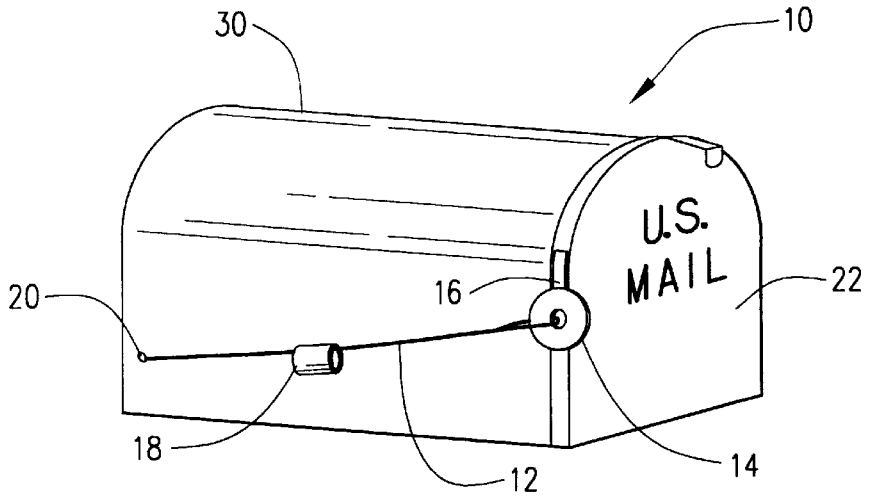
FIG. 1 is a perspective representation of the delivered mail indicating system combined with a mail delivery system, such as a mailbox with a hinged door, and constructed of a mail delivery signal kit attached to the mail delivery system.

Referring now to the drawings, FIG. 1 illustrates schematically a delivered mail indicating system. A delivered mail indicating system 10 is formed when a mail delivery signal kit is attached to a mailbox 30. The mail delivery signal kit in one embodiment contemplated herein comprises a tethering device 12, a stopper 14, a magnet 16, and a visual indicator device 18, and may be supplied or sold together as a kit. Screws or other elements means may also be supplied in the kit.

The mailbox 30 is preferably a rural-type street side metal or nonmetal (e.g. plastic or wooden) mail delivery box, which has a hinged door 22, with a height approximately 8⅞", a length approximately 18⅞" and a width approximately 6¾". The mailbox 30 may be located some distance from a residence or business, and it is generally necessary to leave the residence or business to retrieve mail deposited in the mailbox 30.

The magnet 16 is attached to an outer portion of the hinged mailbox door 22, such as the side or face of the door 22, by any effective securing elements such as a screw, an adhesive bonding material which may be disposed on the lower surface of the magnet 16, a rivet, a clip, or other fastener (e.g. VELCRO). The bonding material when present can be for example glue, cement, an epoxy, or any like material for securing the magnet 16 to the mailbox door 22, and may further comprise a release strip disposed thereon.

The stopper 14 is constructed of any metallic material which can form a magnetic connection with the magnet 16. The stopper 14 in a preferred embodiment is separate from and directly attachable to the tethering device 12. A magnetic connection can be formed between the magnet 16 and the stopper 14 when the mailbox door 22 is closed and the stopper is connected to the magnet, as schematically illustrated in FIG. 1. In an alternative embodiment, the stopper 14 itself may be a magnet or magnetized and can form a magnetic connection with a metal portion of the mailbox door thereby eliminating the need for a separate magnet attached to the mailbox door 22. The tethering device 12 in preferred embodiments is constructed from a chain, string, cord, rope, wire, or plastic coated wire, for example. The first end of the tethering device 12 is connected in a preferred embodiment to the mailbox 30 or the mailbox support (not shown) via a tether-connecting aperture 20, while the second end of the tethering device 12 is connected to the stopper 14.

The stopper 14 can be connected to the tethering device 12 by several methods. As pictorially represented in FIGS. 1–3, the stopper 14 may have a hole in its center wherein the stopper is a "washer", allowing the tethering device 12 to be threaded through the center hole of the stopper 14. A small hole in the stopper 14 would also allow connection to the tethering device 12 by using a screw attached to the tethering device 12. The stopper 14 can also be secured to the tethering device 12 by welding. In addition, the tethering device 12 can be clipped or otherwise secured to the stopper 14. Other methods of attaching the stopper 14 to the tether 12 will be readily apparent to a person of ordinary skill in the art.

As noted above, the first end of the tethering device 12 is connected to the mailbox 30 or the mailbox support. The tethering device 12 is preferably easy to install and is preferably easily removed when the owner of the mailbox desires no notification of mail delivery, and can be reinstalled when the circumstances change. The tethering device 12 may be threaded through or secured to an aperture 20 on a mailbox 30, which may be preexisting or may be drilled on the mailbox 30. In an alternative embodiment, an eyescrew or other similar attaching elements can be installed on the mailbox 30. Other elements for connecting the tether 12 include screws or clips to which the tethering device 12 is welded, screwed, or otherwise attached. Each of these tether-connecting elements will allow the tethering device 12 to be threaded through or otherwise secured so that the tethering device 12 is securely attached to the mailbox 30 or the mailbox support.

The connected end of the tether 12 can be attached to the mailbox 30 in several positions, including the side of the mailbox 30 and the lower surface of the mailbox 30. The distance of the connected end of the tether 12 from the mailbox door 22 can also vary. For example, in FIG. 1, the connection of the tether 12 is located at the end of the mailbox 30 opposite to the door 22, but the tether 12 may be connected at some point between the opposite ends of the mailbox 30 much closer to the mailbox door 22. Additionally, the length of the tethering device 12 can also vary. In an alternative embodiment, the tethering device 12 may be a chain whose length can be adjusted to accommodate the size and length of the mailbox 30. However, the location of the tether connection in relation to the magnet 16 on the mailbox door 22 must be related to the length of the tethering device 12. Although both the length of the tethering device 12 and the position of the tether connection can vary, the position of the tether connection must be such that the tethering device 12 is long enough for the stopper 14 connected to the second end of the tethering device 12 to be able to be magnetically connected to the magnet 16 attached to the mailbox door 22 when the mailbox door 22 is in the closed position, but the tethering device 12 must be of a length such that the magnetic connection between the stopper 14 and the magnet 16 is broken when the mailbox door 22 is opened for deposition of mail.

Another component of the mail delivery signal kit is the visual indicator device 18. The visual indicator device 18 is the component of the mail delivery signal kit which must be conspicuously visible from a distance, so at least a portion of the visual indicator device 18 is a material which is brightly colored, iridescent, fluorescent, metallic, mirrored, sparkled, or any combination thereof or otherwise conspicuously decorated. The material used to construct the visual indicator device 18 does not have to inherently possess the visually conspicuous features. The visual indicator device 18 can be constructed of various materials, including paper, cardboard, plastic, resin, metal, wood, and various types of plastic piping, to which a layer of paint is applied or glue is applied for attaching another conspicuously apparent material.

Figure 2:
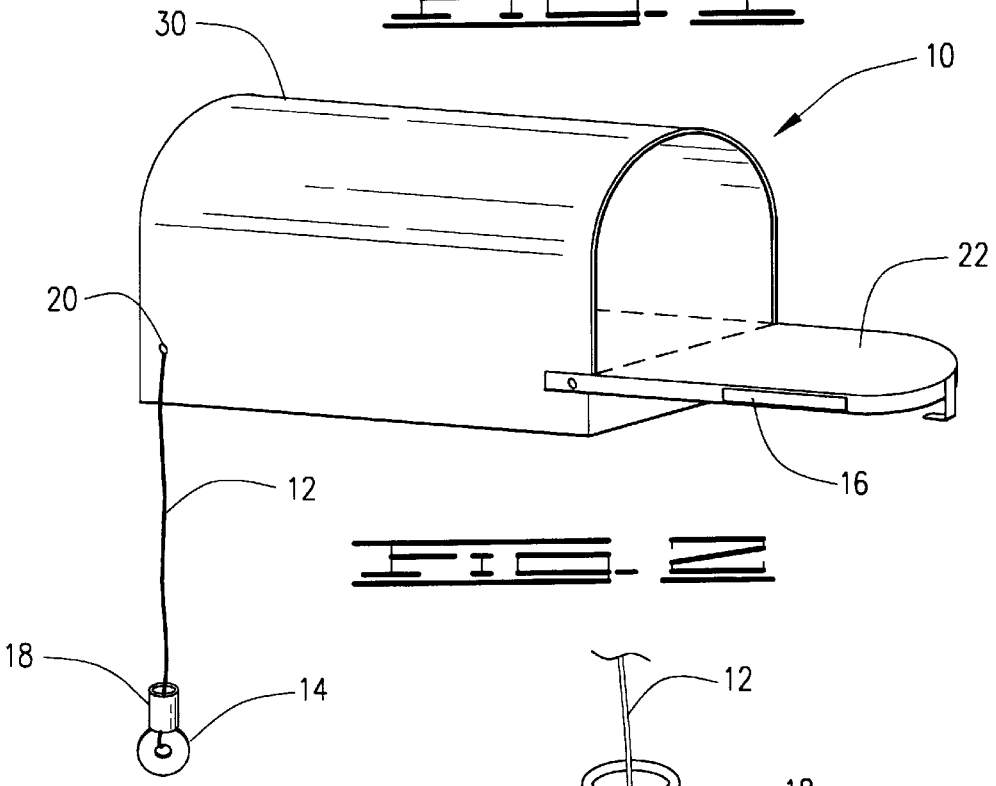
FIG. 2 is a perspective representation of the delivered mail indicating system combined with a mailbox with an open door and constructed of a mail delivery signal kit attached to the mailbox. The delivered mail indicating system is illustrated in a signaling position in accordance with the present invention.
Figure 3:
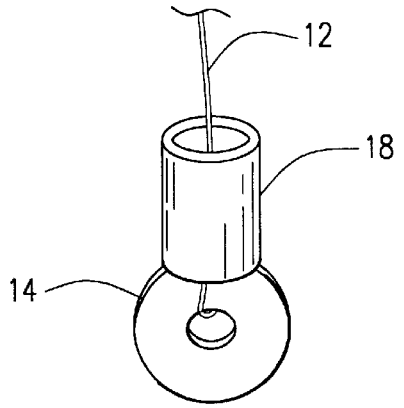
FIG. 3 is a perspective representation of the indicator device in the signaling position and being retained on the tethering device due to the securing of the stopper.

The visual indicator device 18 in a preferred embodiment has a lumen extending diametrically across the device and may be cylindrical, as schematically illustrated in FIGS. 1–3, but can also take on many other shapes which can have a lumen therethrough and exposed outer surfaces which can be visible from a distance. For example, the visual indicator device 18 may also be spherical, rectangular, square, or disk-like.

Where the visual indicator device 18 the lumen must have an internal diameter larger than the exterior diameter of the tethering device 12, so that the tethering device 12 can be threaded through the lumen of the visual indicator device 18, allowing the visual indicator device 18 to freely move along the length of, or a significant portion of, the tethering device 12. Additionally, the internal diameter of the lumen of the visual indicator device 18 must be smaller than the outer diameter of the stopper 14, since an important function of the stopper 14 is to retain the visual indicator device 18 on the tethering device 12 upon release of the stopper 14 from the magnetic connection with the magnet 16, causing the stopper 14 to fall and extend the tethering device 12 downward, as schematically represented in FIG. 2. FIG. 3 schematically illustrates the tethering device 12 threaded through the visual indicator device 18, and the stopper 14 having a greater outer diameter than the inner diameter of the visual indicator device 18 so as to retain the visual indicator device 18 on the tethering device 12. It is in this downwardly hanging position in which the visual indicator device 18 provides a visual signal that mail has been delivered. Preferably, the visual indicator device 18 swings in a direction toward the rear end of the mailbox 30 as the visual indicator device 18 falls downwardly.

In an alternative embodiment, the visual indicator device 18 may be non-movable attached to the tether 12 between the first end of the tether and the second end of the tether.

The process of preparing the mailbox 30 for the signaling of the delivery of mail is initiated by attaching the mail delivery signal kit to the mailbox 30. The delivery indicating system is activated by closing the mailbox door 22 and magnetically connecting the stopper 1 4 to the magnet 1 6 on the mailbox door 22, as schematically illustrated in FIG. 1. Opening of the mailbox door 22 to insert articles such as mail will pull the magnet 16 away from the stopper 14, and when the length of the tethering device 12 is pulled taut, the stopper 14 becomes disconnected from the magnet 16. Gravity causes the stopper 14 to fall, pulling the tethering device 12 into a downwardly hanging position. The visual indicator device 18 slides down the tethering device 12 until it is stopped by the stopper 14, which prevents the visual indicator device 18 from falling off the end of the tethering device 12, as schematically illustrated in FIGS. 2 and 3. The visual indicator device 18 is now in a signaling position to notify the owner of the mailbox 30 that the mailbox door 22 has been opened and articles have been placed inside the mailbox 30.

In an alternative embodiment, the visual indicator device 18 may itself be metallic or magnetic so that a stopper 14 is unnecessary. In this embodiment, the visual indicator device

18 is attached to the end of the tethering device 12, can be magnetically connected to the door 22 of the mailbox 30, and is itself visually obvious and conspicuous. In this case, the mailbox door 22, or a portion thereof must be metallic or must have a metallic component attached thereto to attract to the magnetic indicator device 18 or to the magnetic stopper 14.

Changes may be made in the embodiments of the invention as described herein, or in parts or elements of the embodiments described herein, or in the steps or sequence of steps of the methods described herein, without departing from the spirit and/or scope of the invention as defined in the following claims.

What is claimed is:

1. A signaling kit, comprising:

a magnet having a first surface and a second surface and attachable to a surface;

a tethering device;

a stopper having a first and a second surface, and constructed of a material able to be attracted by the magnet and wherein the stopper is separate from and directly attachable to a second end of the tethering device; and a visual indicator device adapted to be slidably disposed upon or attached to the tethering device.

2. The signaling kit of claim 1 wherein the tethering device has or can be adjusted to have a length which is approximately eighteen and seven eighths inches or less.

3. The signaling kit of claim 1 wherein at least a portion of the visual indicator device is brightly colored, iridescent, fluorescent, mirrored, metallic, sparkled, or combinations thereof.

4. The signaling kit of claim 1 wherein the tethering device is a chain, string, cord, rope, wire, or plastic coated wire.

5. The signaling kit of claim 1 further comprising a securing element for connecting a first end of the tethering device to a mailbox or a mailbox support.

6. The signaling kit of claim 1 further comprising a securing element for securing the stopper to the second end of the tethering device.

7. A mailbox assembly, comprising:

a mailbox having a hinged door;

a magnet attached to a surface of the hinged door;

a tethering device connected at a first end thereof to the mailbox or to a mailbox support upon which the mailbox is disposed;

a stopper constructed of a material able to be attracted by the magnet and connected to a second end of the tethering device; and a visual indicator device slidably disposed upon or attached to the tethering device.

8. The mailbox assembly of claim 7 wherein the tethering device has or can be adjusted to have a length which is approximately eighteen and seven eighths inches or less.

9. The mailbox assembly of claim 7 wherein at least a portion of the visual indicator device is brightly colored, iridescent, fluorescent, metallic, mirrored, sparkled, or combinations thereof.

10. The mailbox assembly of claim 7 wherein the tethering device is a chain, string, cord, rope, wire, or plastic coated wire.

11. The mailbox assembly of claim 7 further comprising a securing element for connecting the first end of the tethering device to the mailbox or mailbox support.

12. The mailbox assembly of claim 11 wherein the tethering device is welded, screwed, clipped, or otherwise secured to the mailbox or mailbox support.

13. The mailbox assembly of claim 7 further comprising a securing element for securing the second end of the tethering device to the stopper.

14. A method of activating a mail delivery signal, comprising:

providing a mailbox assembly, comprising:

a mailbox having a hinged door, a magnet attached to a surface of the hinged door, a tethering device connected at a first end thereof to the mailbox or to a mailbox support upon which the mailbox is disposed, a stopper constructed of a material able to be attracted by the magnet and connected to a second end of the tethering device, and a visual indicator device slidably disposed upon or attached to the tethering device; and magnetically connecting the stopper to the magnet attached to the door of the mailbox when the door is in a closed position thereby activating the mail delivery signal, and wherein when the door of the mailbox is opened, the magnet is pulled away from the stopper until the stopper disconnects from the magnet, causing the stopper to fall below the mailbox wherein the visual indicator device drops down the tethering device and is arrested by the stopper indicating mail delivery.

15. The method of claim 14 wherein, in the step of providing the mailbox assembly, the tethering device has or can be adjusted to have a length which is approximately eighteen and seven eighths inches or less.

16. The method of claim 14 wherein, in the step of providing the mailbox assembly, at least a portion of the visual indicator device is brightly colored, iridescent, fluorescent, metallic, mirrored, sparkled, or combinations thereof.

17. The method of claim 14 wherein, in the step of providing the mailbox assembly, the tethering device is a chain, string, cord, rope, wire, or plastic coated wire.

18. The method of the mailbox assembly of claim 14 wherein the tethering device is connected to the mailbox or mailbox support via a weld, a screw, a clip, or other fastening element or is threaded through an aperture in the mailbox.

* * * * *